United States Patent [19]

Ganser et al.

[11] Patent Number: 5,025,197

[45] Date of Patent: Jun. 18, 1991

[54] CIRCUIT ARRANGEMENT FOR A.C. OPERATION OF HIGH-PRESSURE GAS DISCHARGE LAMPS

[75] Inventors: Hans G. Ganser, Stolberg; Ralf Schäfer, Aachen; Hans P. Stormberg, Stolberg, all of Fed. Rep. of Germany

[73] Assignee: U.S. Philips Corporation, New York, N.Y.

[21] Appl. No.: 708,316

[22] Filed: Mar. 5, 1985

[30] Foreign Application Priority Data

Mar. 8, 1984 [DE] Fed. Rep. of Germany ..... 3408426

[51] Int. Cl.[5] ..... H05B 37/02

[52] U.S. Cl. ..... 315/172; 315/209; 315/DIG. 7

[58] Field of Search ..... 315/172, 72, 209 R, 315/93, 177, 276, DIG. 7

[56] References Cited

U.S. PATENT DOCUMENTS

| | | | |
|---|---|---|---|
| 3,411,108 | 11/1968 | Phillips | 363/49 |
| 4,087,722 | 5/1978 | Hancock | 315/DIG. 7 |
| 4,320,326 | 3/1982 | Banziger et al. | 315/199 |
| 4,378,514 | 3/1983 | Collins | 315/276 |
| 4,392,081 | 7/1983 | Brown et al. | 315/92 |
| 4,464,607 | 8/1984 | Peil et al. | 315/209 R |

FOREIGN PATENT DOCUMENTS 1092199 11/1967 United Kingdom .

*Primary Examiner*—David K. Moore

*Attorney, Agent, or Firm*—Bernard Franzblau

[57] ABSTRACT

A circuit arrangement for A.C. operation of high-pressure gas discharge lamps comprising a mains alternating voltage source and a high-frequency oscillator (3) supplied with direct current and which produces a high-frequency current through the lamp superimposed on the mains alternating lamp current. The oscillator comprises a high-frequency transformer (7) and a transistor (11) connected in series with the transformer primary (8). The transistor can be periodically switched on an off. A secondary (9) of the transformer is connected in series with the lamp. Losses are reduced if the ratio between the switching-on and switching-off time (duty cycle) of the transistor (11) is chosen so small that the effective value of the high-frequency current coupled into the lamp lies between 0.05 and 5% of the mains alternating lamp current. An auxiliary device (16 to 19, 25) interrupts the periodic switching of the transistor (11) outside the proximity of the zero passages of the mains alternating lamp current.

21 Claims, 1 Drawing Sheet

CIRCUIT ARRANGEMENT FOR A.C. OPERATION OF HIGH-PRESSURE GAS DISCHARGE LAMPS

BACKGROUND OF THE INVENTION

This invention relates to a circuit arrangenment for A.C. operation of high-pressure gas discharge lamps comprising a current limiter arranged between the lamp and the mains alternating voltage source and a high-frequency oscillator supplied with direct current and producing a high-frequency current through the lamp superimposed on the mains alternating lamp current. The oscillator comprises a high-frequency transformer and a transistor which is connected in series with the primary of the transformer and can be periodically switched on and off, while a secondary of the transformer is connected in series with the lamp. As a current limiter, use may be made of an ohmic resistor, a choke coil or an electronic ballast unit.

A problem in the operation of high-pressure gas discharge lamps is the lamp re-ignition after each zero passage of the mains alternating lamp current. More particularly, in metal halide discharge lamps, re-ignition voltages may be required during the heating-up stage that are higher than can be supplied by the ballast unit or the like, whereupon the lamp extinguishes. In order to facilitate the ignition and re-ignition, respectively, of high-pressure gas discharge lamps, an additional high frequency current has therefore been superimposed on lamps operated from a mains alternating voltage source.

In a circuit arrangement of this kind known from U.S. Pat. No. 4,378,514, in addition a high voltage having a frequency of 1.6 to 200 kHz is applied for igniting the lamps. This voltage is switched off again after ignition of the lamp. This high high-frequency voltage is higher than the ignition voltage of the lamps and could be at least 1000 V. The high-frequency oscillator has therefore to be constructed for such a voltage, which requires comparatively large high-power physical elements.

GB-PS No. 1,092,199 also discloses a circuit arrangement for A.C. operation of gas discharge lamps in which an additional high-frequency current is superimposed on the mains alternating lamp current, as a result of which the re-ignition voltage is reduced. The high-frequency superimposition takes place during the whole period duration of the mains alternating lamp current. The high-frequency current is about 10% of the average mains alternating lamp current. Thus, once again a comparatively large high-frequency oscillator is required.

SUMMARY OF THE INVENTION

The invention has for an object to provide a circuit arrangement for A.C. operation of high-pressure gas discharge lamps with a low re-ignition voltage, more particularly during the heating-up stage of the lamps, in which the individual elements of the circuit arrangement—except the current limiter—are kept so small and exhibit such low losses that an integration of the circuit arrangement in the lamp base or in the lamp cap becomes possible without the elements being thermally destroyed because of losses in the circuit arrangement. According to the invention, this object is achieved in a circuit arrangement of the kind mentioned in the opening paragraph in that the ratio between switching-on time and switching-off time (duty cycle) of the transistor is chosen so low that the effective value of the high-frequency current coupled into the lamp lies between 0.05 and 5% of the mains alternating lamp current, and in that an auxiliary device is provided which shunts a low resistance across the base-emitter path of the transistor outside the proximity of the zero passages of the mains alternating lamp current.

The invention is based on the discovery that surprisingly a comparatively low additional high-frequency power is sufficient for reducing the re-ignition voltage of high-pressure gas discharge lamps. This power is less than 5% of the nominal lamp power. The frequency of the high-frequency current may lie approximately between 50 kHz and 1 MHz. A favourable value is, for example, 200 kHz. The required high-frequency voltage lies approximately between 100 and 200 V, i.e. it is of the order of the lamp operating voltage. It has further been found that, for avoiding re-ignition difficulties, it is sufficient that the high-frequency power, which is low as compared with the normal lamp power, be coupled-in only in the proximity of the zero passages of the mains alternating lamp current.

In a favorable embodiment of the circuit arrangement according to the invention, the duty cycle of the transistor can be adjusted to the desired value in that the base of the transistor is connected to a second secondary of the high-frequency transformer, whose other end is acted upon by the direct voltage supply of the high-frequency oscillator divided via a voltage divider. The duty cycle of the transistor can be decreased by a reduction of the divided supply direct voltage and/or by an increase in the number of turns of the second secondary.

In a preferred circuit arrangement according to the invention, the auxiliary device includes a further transistor which shunts the base-emitter path of the first transistor and which, when a given instantaneous lamp current is exceeded, switches the first transistor to the non-conductive state in that the base of the further transistor is acted upon, via a potentiometer, by the rectified signal of a current sensor measuring the instantaneous lamp current. The current sensor used is, for example, an alternating current converter or a measuring resistor.

It is then sufficient when the high-frequency oscillator operates with a low efficiency of, for example, 50% so that comparatively inexpensive elements can be employed. The dissipation loss of the high-frequency oscillator can be reduced to about 10% of the dissipation loss that occurs with continuous operation. Moreover, the storage capacitor of the high-frequency oscillator can be charged in this case to the peak value of the mains voltage because no power is extracted from it at the maximum of the mains voltage. Consequently, the voltage supplied by the high-frequency oscillator at the zero passages of the mains voltage is higher than with continuous operation. This is advantageous for the reignition behavior of the lamp and permits of obtaining a smaller number of turns of the secondary connected in series with the lamp so that the size and cost of the high-frequency transformer are reduced.

Reignition difficulties in high-pressure gas discharge lamps mainly occur during the heating-up stage of the lamps. Therefore, the high-frequency oscillator needs to oscillate only during this heating-up stage. When the lamp voltage has reached its nominal value after the heating-up stage, the high-frequency oscillator can be switched off thereby further reducing the losses in the circuit arrangement. This is effected in a further preferred embodiment of the circuit arrangement according to the invention in that the base-emitter path of the transistor is shunted by a further transistor which switches the first transistor to the cutoff state in dependence upon the effective lamp voltage. This is accomplished in that the base of the further transistor is acted upon by the voltage of a smoothing capacitor, which is connected via a diode parallel to a resistor of a second voltage divider, which is in turn connected parallel to the series arrangement of the lamp and the first secondary.

If the circuit is to include both measures, i.e. if the high-frequency oscillator is to oscillate only in the proximity of the zero passages of the mains alternating lamp current and be switched off after the heating-up stage of the lamps, according to a further embodiment of the circuit arrangement in accordance with the invention, the smoothing capacitor is connected via a second diode, and the tapping on the potentiometer via a third diode, to the base of the further transistor. Thus, a mutual decoupling of the voltages of the potentiometer and of the smoothing capacitor is attained.

BRIEF DESCRIPTION OF THE DRAWING

In order that the invention may be readily carried into effect, it will now be described more fully with reference to the accompanying drawing, in which.

DESCRIPTION OF THE PREFERRED EMBODIMENTS

Figure 1:
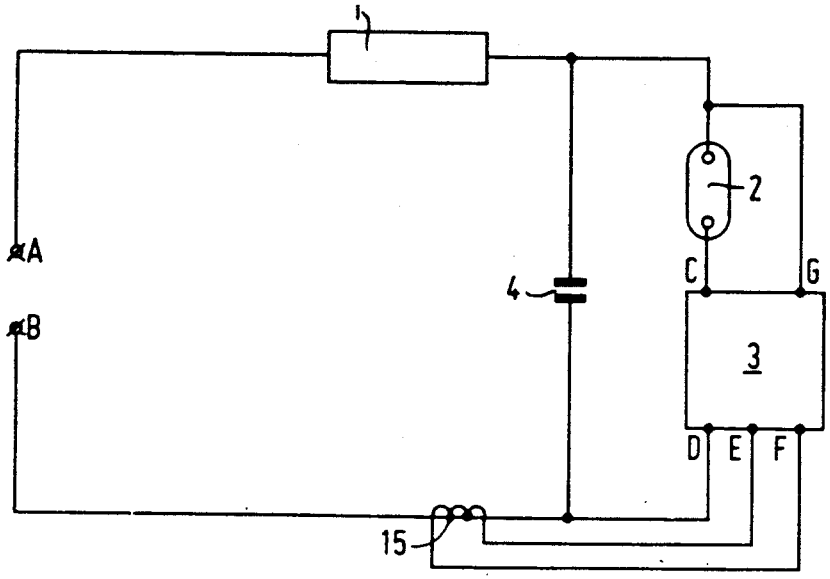
FIG. 1 shows a circuit arrangement for A.C. operation of a high-pressure gas discharge lamp which is connected in series with a high-frequency oscillator and which is additionally controlled by the lamp current.

A and B designate input terminals for connection to an alternating voltage mains of, for example, 220 V, 50 Hz. A high-pressure gas discharge lamp 2 is connected in series with a high-frequency oscillator 3 to the input terminals through a ballast current limiter 1.

The outputs of the high-frequency oscillator 3 are designated by C and D. The current limiter 1 may be an ohmic resistor, a choke coil or an electronic ballast unit. A high-frequency return capacitor 4 is connected parallel to the lamp 2 and to the high-frequency oscillator 3 and this capacitor prevents the feedback of high-frequency currents into the alternating voltage mains. The high-frequency oscillator 3 couples, in addition to the 50 Hz mains alternating lamp current, a small high-frequency current having a frequency lying between 50 kHz and 1 MHz into the lamp 2. Usually, the high-frequency oscillator 3 would operate during the whole A.C. period. In order to reduce the losses in the circuit arrangement, the high-frequency oscillator 3 should oscillate only in the proximity of the zero passages of the mains alternating lamp current. For this purpose, provision is additionally made of a current sensor 15, for example in the form of an A.C. converter, which measures the lamp current and passes it on to input terminals E and F of the high-frequency oscillator 3. A further input G of the high-frequency oscillator 3 is connected to the electrode of the lamp 2 not connected to the output C of the high-frequency oscillator 3.

Figure 2:
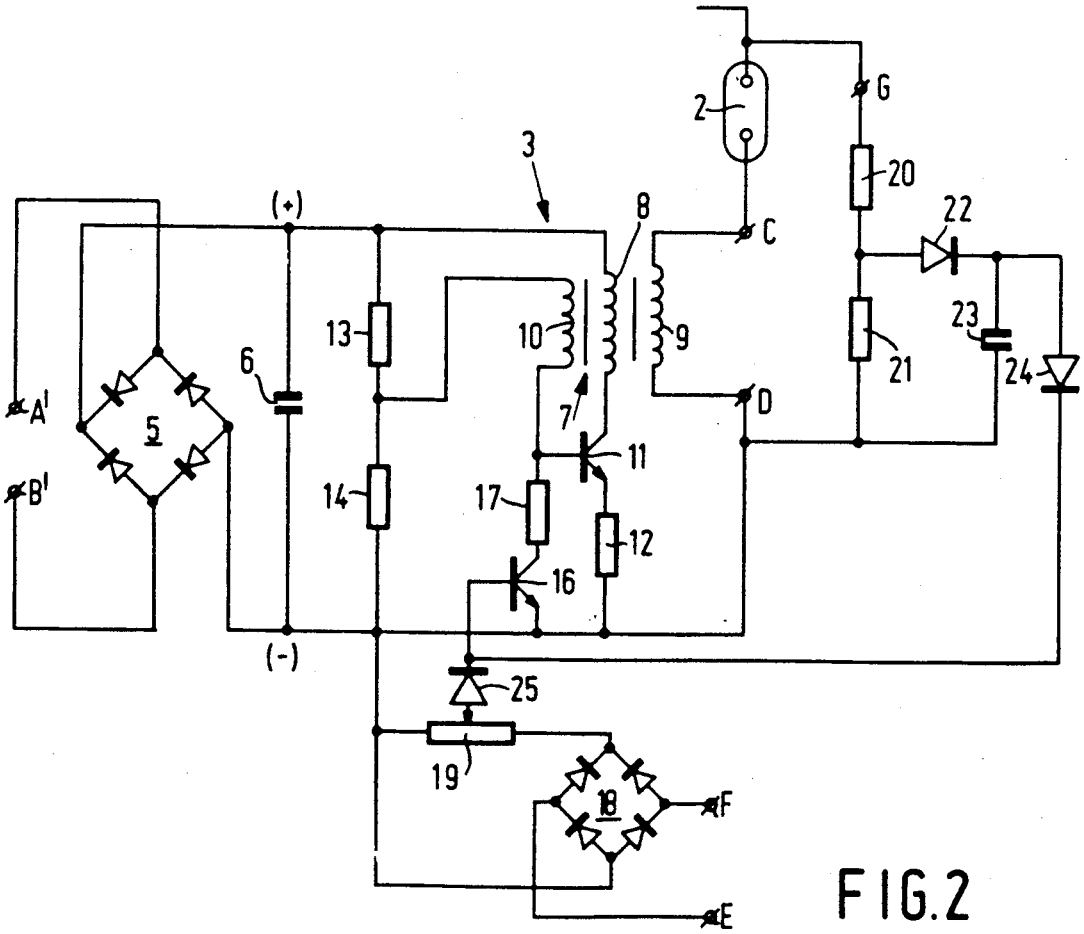
FIG. 2 shows the circuitry of the high-frequency oscillator used in the circuit arrangement shown in FIG. 1.

An embodiment of a suitable high-frequency oscillator 3, which operates according to the principle of a switching converter, is shown in FIG. 2. The input terminals A', B' of the alternating voltage mains is connected to a bridge rectifier 5. The output of the bridge rectifier is connected in parallel with a charging capacitor 6. The rectifier arrangement 5, 6 constitutes a direct voltage source for the actual high-frequency oscillator 3. The latter essentially comprises a high-frequency transformer 7 having a primary 8 and two secondaries 9 and 10 as well as a transistor 11 that is connected in series with the primary 8 and can be periodically switched off and switched on. The high-frequency transformer 7 is connected by its primary 8 in series with the transistor 11 and a resistor 12 to the charging capacitor 6. The first secondary 9 of the high-frequency transformer 7 is connected in series with the lamp 2. Furthermore, a voltage divider consisting of resistors 13 and 14 is connected parallel to the charging capacitor 6. The tapping on the voltage divider located between the two resistors 13 and 14 is connected to one end of the second secondary 10 of the high-frequency transformer 7. The other end of secondary winding 10 is connected to the base of the transistor 11.

This circuit arrangement operates as follows: The rectified mains voltage is applied to the output of the bridge rectifier 5, as a result of which the charging capacitor 6 is charged. A current then flows from this capacitor through the series arrangement of the primary 8 of the high-frequency transformer 7, the switching transistor 11 and the resistor 12. The ratio of the resistors 13 and 14 of the voltage divider is chosen so that the divided supply direct voltage and hence the base voltage applied to the switching transistor 11 is sufficient to make the switching transistor 11 conduct. The rise time of this current is determined by the time constant resulting from the resistor 12 and the self-inductance of the primary 8. With the rise of the current through the primary 8, a voltage is induced in the second secondary 10 which counteracts the voltage supplied by the voltage divider ratio of the resistors 13, 14 and hence reduces the base voltage of the transistor 11 to such low values that the transistor 11 becomes non-conducting. As a result, the current through the primary 8 is interrupted so that again the inverse voltage induced in the second secondary 10 is reduced. Thus, the transistor 11 returns to its starting position and the whole process starts again, as a result of which a high-frequency current oscillation is obtained as a whole in the primary 8. This oscillation results in a high-frequency voltage being induced in the secondary 9, which voltage is coupled via the output terminals C and D into the circuit arrangement shown in FIG. 1.

The ratio between the switching-on time and the switching-off time (duty cycle) of the transistor 11 is chosen, by reduction of the ratio of the voltage divider resistors 14 to 13, i.e. by reduction of the divided supply voltage for supplying the high-frequency oscillator 3 and/or by the increase of in the number of turns of the second secondary 10, to be so small that the effective value of the high-frequency current coupled into the lamp 2 lies between 0.05 and 5% of the mains alternating lamp current. The once adjusted duty cycle of the transistor 11 moreover determines the oscillation frequency of the high-frequency oscillator 3.

As appears from FIG. 2, the base-emitter path of the switching transistor 11 is shunted by a further transistor 16 in series with a resistor 17. The signal applied by the current sensor 15 to the input terminals E and F of the high-frequency oscillator 3 is rectified by a rectifier bridge 18 and is supplied via a potentiometer 19 to the base of the second transistor 16. The value of the base voltage is adjustable by means of the potentiometer 19.

The oscillator circuit described so far operates as follows:

If the signal of the current sensor 15 is small, i.e. in the proximity of the current zero passages, the base voltage of the transistor 16 is also small and the transistor 16 is in the non-conductive state. In this case, the switching transistor 11 and hence the high-frequency oscillator 3 operates in the manner described above. When the lamp current and hence the base voltage of the transistor 16 now exceeds a given value, the transistor 16 becomes conductive so that the smaller resistor 17 is connected parallel to the resistor 14. As a result, the base voltage of the transistor 11 is reduced so far that this transistor remains non-conducting and the high-frequency oscillator 3 thus cannot oscillate. The threshold voltage of the lamp current at which the oscillation is prevented can then be adjusted via the potentiometer 19.

The circuit arrangement shown in FIG. 2 also makes it possible to switch off the high-frequency oscillator 3 after the heating-up stage of the lamp 2. As a result even smaller losses and hence an even weaker heating are obtained. For this purpose, the lamp voltage applied to the input G of the high-frequency oscillator 3 is fed via a voltage divider comprising resistors 20 and 21 and a diode 22 to a smoothing capacitor 23. The time constant of the resistor 20 and of the smoothing capacitor 23 is designed so that there is applied to the smoothing capacitor 23 a voltage which is proportional to the average lamp voltage. The voltage applied to the smoothing capacitor 23 is then fed via a second diode 24 to the base of the further transistor 16. At the same time, the voltage derived at the potentiometer 19 is fed via a third diode 25 to the base of the further transistor 16. The two diodes 24 and 25 then prevent the current-proportional signal originating from the potentiometer 19 and the voltage-proportional signal originating from the smoothing capacitor 23 from influencing each other. Thus, the high-frequency oscillator 3 is switched off outside the proximity of the zero passages of the lamp alternating current because the voltage derived from the potentiometer 19 switches the further transistor 16 to the conductive state. In addition, when a given average lamp voltage is exceeded the voltage derived from the smoothing capacitor 23 switches the further transistor 16 to the conductive state. The switching threshold for the operating voltage of the lamp is adjusted via the voltage divider 20, 21 so that the high-frequency oscillator 3 is switched off only after the heating-up stage of the lamp 2, i.e. at a voltage which approximately corresponds to the normal operating voltage of the lamp.

In a practical embodiment for A.C. operation of a 45 W metal halide high-pressure discharge lamp having an operating voltage of 100 V, in a circuit arrangement of the kind shown in FIG. 2, the following circuit elements were employed:

| | |
|---|---|
| resistor 12 | 150Ω |
| resistor 17: | 390Ω |
| resistor 14: | 1.8 kΩ |
| resistor 13: | 120 kΩ |
| resistor 20: | 82 kΩ |
| resistor 21: | 6.8 kΩ |
| potentiometer 19: | 1 kΩ |
| capacitor 4: | 1 nF |
| capacitor 6: | 0.5/uF |
| capacitor 23: | 0.2/uF |

-continued

| | |
|---|---|
| transistor 11: | BUX 86 |
| transistor 16: | BC 107 |
| diodes 22, 24, 25: | 1N448 |

high-frequency transformer 7 turns ratio; primary 8: secondary 10: secondary 9 = 22: 6:20.

The oscillation frequency of the high-frequency oscillator was about 200 kHz with a peak voltage of about 200 V. The metal halide discharge lamps passed through their heating-up stage without reignition problems. The mains alternating lamp current was about 0.6 A and the effective value of the high-frequency current was about 0.5 mA.

In the embodiments described the lamp is connected in series with the high-frequency oscillator. However, it is alternatively possible to connect the high-frequency oscillator parallel to the lamp and to establish the connection through two capacitors.

What is claimed is:

1. A circuit arrangement for A.C. operation of high-pressure gas discharge lamps comprising: a ballast current limiter coupled between the lamp and a mains alternating voltage source, a high-frequency oscillator supplied with direct current and producing a high-frequency current through the lamp superimposed on the mains alternating lamp current, said oscillator comprising a high-frequency transformer, a first transistor connected in series with a primary of the transformer, the first transistor being periodically switched on and switched off, means connecting a first secondary of the transformer in series with the lamp, the ratio between switching-on time and switching-off time (duty cycle) of the first transistor being so small that the effective value of the high-frequency current coupled into the lamp during stable lamp operation lies between 0.05 and 5% of the mains alternating lamp current, and an auxiliary device connected to provide a low resistance shunt across the base-emitter path of the first transistor outside the proximity of the zero passages of the mains alternating lamp current.

2. A circuit as claimed in claim 1, wherein a base of the first transistor is connected to a second secondary of the high-frequency transformer, means further connecting of the second secondary via a voltage divider to a source of direct voltage for the high-frequency oscillator, and wherein the duty cycle of the transistor can be reduced by reduction of the divided direct voltage and/or by an increase of the number of turns of the second secondary.

3. A circuit as claimed in claim 1 wherein the auxiliary device includes a further transistor connected in shunt with the base-emitter path of the first transistor and which, when the instantaneous lamp current exceeds a given value, switches the first transistor to the non-conductive state, the base of the further transistor being controlled, via a potentiometer, by a rectified signal of a current sensor measuring the instantaneous lamp current.

4. A circuit as claimed in claim 2, wherein the base-emitter path of the first transistor is shunted by a further transistor, which switches the first transistor, in dependence upon effective lamp voltage, to the non-conductive state, the base of the further transistor being controlled by the voltage of a smoothing capacitor connected via a diode in parallel with a resistor of a second voltage divider, said second voltage divider in turn being connected parallel to the series arrangement of the lamp and the first secondary of the transformer.

5. A circuit as claimed in claim 4, wherein the smoothing capacitor is connected via a second diode, and the tapping on the potentiometer is connected via a third diode, to the base of the further transistor.

6. A circuit as claimed in claim 1 further comprising, means coupled to the mains alternating voltage source for deriving a direct voltage supply for the high-frequency oscillator, a voltage divider coupled to the output of the direct voltage supply, a second secondary of the high-frequency transformer connected to said voltage divider and to a base of the first transistor, and wherein said voltage divider determines the duty cycle of the first transistor.

7. A circuit as claimed in claim 1 further comprising, means coupled to the mains alternating voltage source for deriving a direct voltage supply for the high-frequency oscillator, a voltage divider coupled to the output of the direct voltage supply, a second secondary of the high-frequency transformer connected to said voltage divider and to a base of the first transistor, and wherein the duty cycle of the first transistor is determined by the number of turns of the second secondary of the high-frequency transformer.

8. A circuit as claimed in claim 1 further comprising, means coupled to the mains alternating voltage source for deriving a direct voltage supply for the high-frequency oscillator, a voltage divider coupled to the output of the direct voltage supply, a second secondary of the high-frequency transformer connected to said voltage divider and to a base of the first transistor, and wherein the auxiliary device includes a further transistor connected in shunt with the base-emitter path of the first transistor and responsive to the lamp current to switch the first transistor into cut-off at a given level of lamp current.

9. A circuit as claimed in claim 1, wherein the auxiliary device includes a further transistor having its collector-emitter path connected in shunt with the base-emitter path of the first transistor, means coupled to the lamp for deriving a D.C. voltage determined by the lamp voltage, and means for supplying said D.C. voltage to a base of the further transistor which in turn switches the first transistor into cut-off in dependence upon the lamp voltage.

10. A circuit as claimed in claim 3 further comprising a resistive voltage divider coupled across the series arrangement of the lamp and the transformer first secondary, a smoothing capacitor coupled to a resistor of the voltage divider via a first diode thereby to develop a D.C. voltage on the capacitor determined by the lamp voltage, a second diode coupling the smoothing capacitor to the base of the further transistor thereby to control the further transistor and the first transistor as a function of the lamp voltage, and a third diode coupling a tapping on the potentiometer to the base of the further transistor thereby to control the base of the further transistor by said rectified signal of the current sensor.

11. Apparatus for operating a discharge lamp comprising: a pair of input terminals for connection to a source of A.C. supply voltage, a high frequency oscillator including a switching transistor connected in series with a primary winding of a high frequency transformer having a secondary winding connected in series with the lamp, a ballast device for coupling the lamp to said input terminals so that the ballast device is operative to limit lamp current in the operating condition of the lamp, said high frequency oscillator supplying a high frequency current to the lamp which is superimposed on an alternating current supplied to the lamp from said input terminals via the ballast device, said switching transistor being switched on and off with a duty cycle such that the effective value of the high frequency current supplied to the lamp lies in the range between 0.05 and 5% of said lamp alternating current, and an auxiliary device coupled to a control electrode of the switching transistor so as to inhibit operation of the high frequency oscillator by causing the switching transistor to be cut-off outside the proximity of a zero passage of alternating lamp current.

12. Apparatus as claimed in claim 11 further comprising means coupling a source of D.C. voltage to said control electrode of the switching transistor of a value so as to at least partly determine the value of said duty cycle of the switching transistor.

13. Apparatus as claimed in claim 11 wherein the high frequency transformer further comprises a second secondary winding coupled to the control electrode of the switching transistor such that the duty cycle thereof is at least partly determined by the number of turns of the second secondary winding of the high frequency transformer.

14. Apparatus as claimed in claim 11 further comprising means coupled to the lamp for deriving a D.C. voltage determined by the lamp voltage, and means for coupling said D.C. voltage to said auxiliary device which in turn causes the switching transistor to be cut-off as a function of the value of lamp voltage.

15. Apparatus as claimed in claim 14 wherein the auxiliary device is responsive to said D.C. voltage to cause the switching transistor to stay cut-off so long as the D.C. voltage is of a value that indicates the lamp operating voltage is approximately at its nominal value.

16. Apparatus as claimed in claim 11 wherein said control electrode is the base of the switching transistor and the auxiliary device comprises a further transistor coupled in shunt with the base-emitter path of the switching transistor and responsive to the lamp current to switch the switching transistor into cut-off above a given level of lamp current in each half cycle of the A.C. supply voltage.

17. Apparatus as claimed in claim 11 wherein the high frequency oscillator is connected in series with the discharge lamp.

18. Apparatus for operating a high pressure discharge lamp comprising: a pair of input terminals for connection to a source of AC supply voltage, a high frequency oscillator including a switching transistor connected in series with a primary winding of a high frequency transformer to a source of D.C. supply voltage, means coupling a secondary winding of said transformer to the lamp so as to couple a high frequency current from the high frequency oscillator to the lamp, a current limiting ballast device for coupling the lamp to said input terminals so that an A.C. current is supplied to the lamp from said input terminals via the ballast device which is operative to limit lamp current in the operating condition of the lamp, said switching transistor switching on and off at a relatively low duty cycle such that the effective value of the high frequency current supplied to the lamp is at most 5% of said lamp AC current, and an auxiliary device coupled to a control electrode of the switching transistor so as to allow operation of the high frequency oscillator only in the proximity of a zero passage of the AC lamp current.

19. An apparatus as claimed in claim 18 further comprising means for controlling operation of the auxiliary device as a function of lamp voltage such that the switching transistor is maintained in a cut-off condition when the lamp voltage is approximately at its nominal operating value whereby the high frequency oscillator ceases operation in the operating condition of the lamp.

20. An apparatus as claimed in claim 18 wherein the auxiliary device includes means responsive to said AC lamp current for switching the switching transistor into cut-off above a given level of AC lamp current in each half cycle of the AC supply voltage.

21. An apparatus as claimed in claim 18 wherein said coupling means couples the transformer secondary winding, the lamp and the ballast device in a series circuit across said pair of input terminals.

* * * * *